US006006934A

United States Patent [19]

Skrysak

[11] Patent Number: 6,006,934

[45] Date of Patent: Dec. 28, 1999

[54] COLLAPSIBLE STORAGE DEVICE

[76] Inventor: Carol Skrysak, 14255 53rd Ave. S., Seattle, Wash. 98168

[21] Appl. No.: 09/019,494

[22] Filed: Feb. 5, 1998

[51] Int. Cl.[6] ..... B65D 30/06; B65D 30/10

[52] U.S. Cl. ..... 220/9.1; 248/205.2; 312/245

[58] Field of Search ..... 220/9.1, 9.2, 23.9; 229/67.3; 248/205.2, 206.5, 683, 467, 309.4, 311.2; 312/5, 6; 383/66

[56] References Cited

U.S. PATENT DOCUMENTS

| | | | |
|---|---|---|---|
| 1,216,250 | 2/1917 | Bittle | 312/6 |
| 1,629,362 | 5/1927 | Robert | 312/6 |
| 1,678,415 | 7/1928 | Ahles | 312/6 |
| 1,757,168 | 5/1930 | Brunell . | |
| 1,847,066 | 3/1932 | Berg | 312/6 |
| 4,483,427 | 11/1984 | Gerch . | |
| 4,526,285 | 7/1985 | Cerveny et al. . | |
| 4,578,814 | 3/1986 | Skamser | 383/66 X |
| 4,887,874 | 12/1989 | Joffe . | |
| 5,009,189 | 4/1991 | Neff . | |
| 5,535,787 | 7/1996 | Howell | 248/205.2 X |
| 5,607,067 | 3/1997 | Morrissey | 248/205.2 X |
| 5,628,552 | 5/1997 | O'Barr . | |

*Primary Examiner*—Allan N. Shoap
*Assistant Examiner*—Joe Merek
*Attorney, Agent, or Firm*—Stratton Ballew PLLC

[57] ABSTRACT

A collapsible storage device which can be attached to the underside of a surface such as a desk top. The storage device includes a top panel, a bottom panel, a first side panel, a second side panel, a rear panel, and a fastener. The top panel and bottom panel being are formed of a substantially rigid material. The first and second side panels and the rear panel are formed of a flexible material. The first side panel is affixed to the top panel and a the bottom panel. Similarly, the second side panel is affixed to the top panel, and the second side panel is affixed to the bottom panel. The rear panel is affixed to the top panel, and the rear panel is affixed to the bottom panel. Additionally, the fastener is affixed to the outward facing surface of the top panel. The storage device can also include an attachment device on the inward facing surface of the top panel. The attachment device can attach to the inward facing surface of the bottom panel. The storage device is compact and lightweight and can store an object or objects in an inconspicuous location near a desk or work-station. It can be collapsed for space-saving packaging, transportation and storage.

12 Claims, 5 Drawing Sheets

COLLAPSIBLE STORAGE DEVICE

TECHNICAL FIELD

The invention pertains to the field of storage containers. More particularly, the invention pertains to a collapsible storage device which can be attached to the underside of a surface such as a desk top.

BACKGROUND OF THE INVENTION

It is a common practice among commuters to carry personal items to their work station at the beginning of their shift, and then carry those same items with them when they leave at the end of their shift. During the time that they are at work, it is necessary to store their belongings in or near their desk or workstation. For example, women who commute to an office building often wear street shoes during their commute, and carry dress shoes to be worn while in the office. It is therefore necessary to store their street shoes in an inconspicuous location while at work.

In addition to personal items, electronic devices and accessories are commonly used at a desk or workstation. Examples of such devices include external tape or CD-ROM drives for the computer, and personal music devices. Often, there is insufficient space on the desktop to accommodate such devices.

Presently, these items are stored in a desk drawer, under the desk, or on the floor in the work area. In addition to being unsightly, the storage of personal items on the floor is at best a nuisance, and at worst a safety hazard.

A multitude of storage devices are available for purchase, primarily in the form of boxes, baskets, and bins. U.S. Pat. No. 5,628,552 to O'Barr shows a portable drawer that can be mounted to the underside of a desk. However, this device is not collapsible, and thus takes up significant space in shipping and merchandising, as well as in transport to the location where it will be used. Furthermore, other conventional storage devices currently available must be placed on the floor or other surface. So, while they may be less unsightly than the objects to be stored, they do not eliminate the clutter and hazard of personal items stored in the work area.

A need exists, therefore, for a device for storing an object or objects in an inconspicuous location near a desk or workstation.

A further need exists for a device for storing an object or objects which is compact and lightweight.

A need also exists for a device for storing an object or objects which can be collapsed for space-saving packaging, transportation and storage.

Yet another need exists for a device for storing an object or objects which will accommodate the power cords commonly found on external tape or CD-ROM drives for the computer, and personal music devices.

SUMMARY OF INVENTION

The present invention is a collapsible storage device which can be attached to the underside of a surface such as a desk top. The storage device includes a top panel, a bottom panel, a first side panel, a second side panel, a rear panel, and a fastener. The top panel and bottom panel being are formed of a substantially rigid material. The first and second side panels and the rear panel are formed of a flexible material. The top panel has a first side edge, a second side edge, a rear edge, a front edge, an outward facing surface and an inward facing surface. The bottom panel has a first side edge, a second side edge, a rear edge, a front edge, an outward facing surface and an inward facing surface. The first side panel and the second side panel each have a top edge and a bottom edge. The rear panel has a top edge and a bottom edge.

The top edge of the first side panel is affixed to the first side edge of the top panel and the bottom edge of the first side panel is affixed to the first side edge of the bottom panel. Similarly, the top edge of the second side panel is affixed to the second side edge of the top panel, and the bottom edge of the second side panel is affixed to the second side edge of the bottom panel.

The top edge of the rear panel is affixed to the rear edge of the top panel, and the bottom edge of the rear panel is affixed to the rear edge of the bottom panel. Additionally, the fastener is affixed to the outward facing surface of the top panel.

In an alternative embodiment of the present invention, the storage device includes an attachment device on the inward facing surface of the top panel. The attachment device can attach to the inward facing surface of the bottom panel.

An advantage of the storage device of the present invention is that it can store an object or objects in an inconspicuous location near a desk or workstation.

Another advantage of the storage device of the present invention is that it is compact and lightweight.

Yet another advantage of the storage device of the present invention is that it can be collapsed for space-saving packaging, transportation and storage.

Still another advantage of the storage device of the present invention is that it can accommodate the power cords commonly found on external data storage devices, such as tape drives and CD-ROM drives for the computer, and personal music devices.

DETAILED DESCRIPTION OF SPECIFIC EMBODIMENTS

Figure 1:
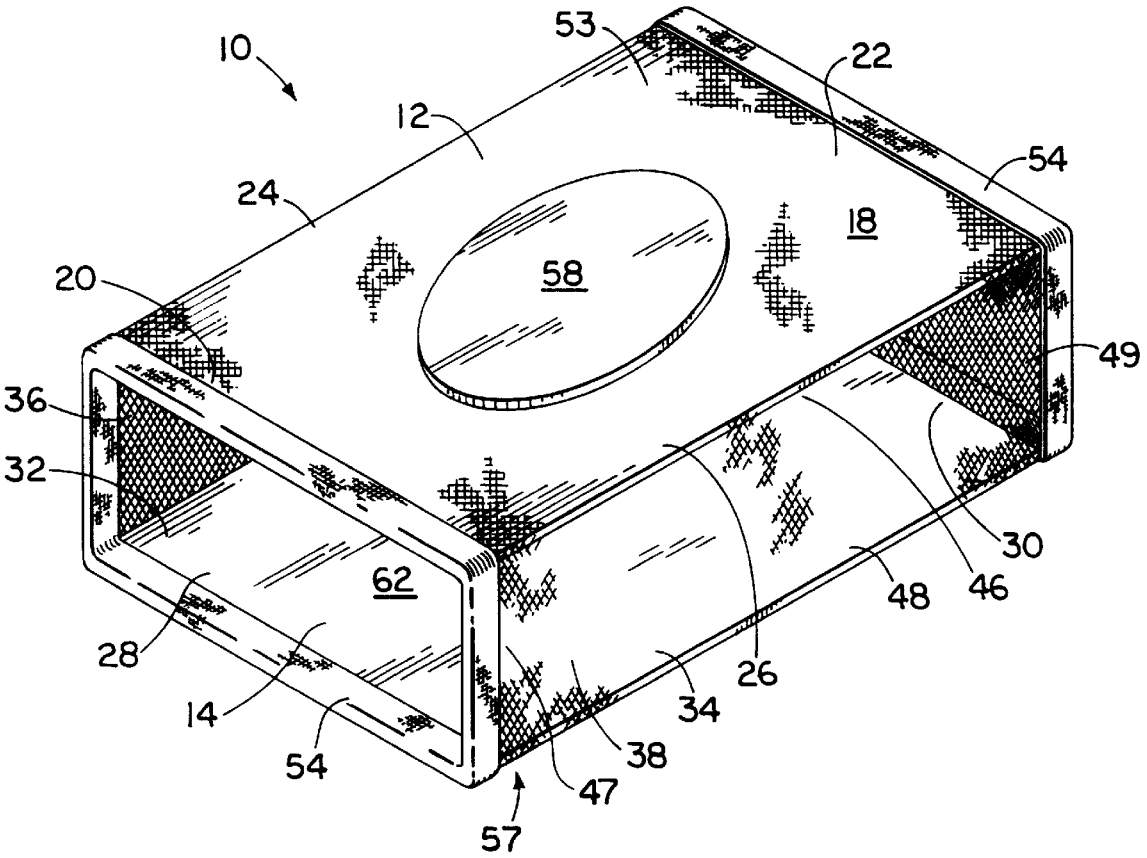
FIG. 1 is a perspective view of a preferred embodiment of a storage device of the present invention.
Figure 2:
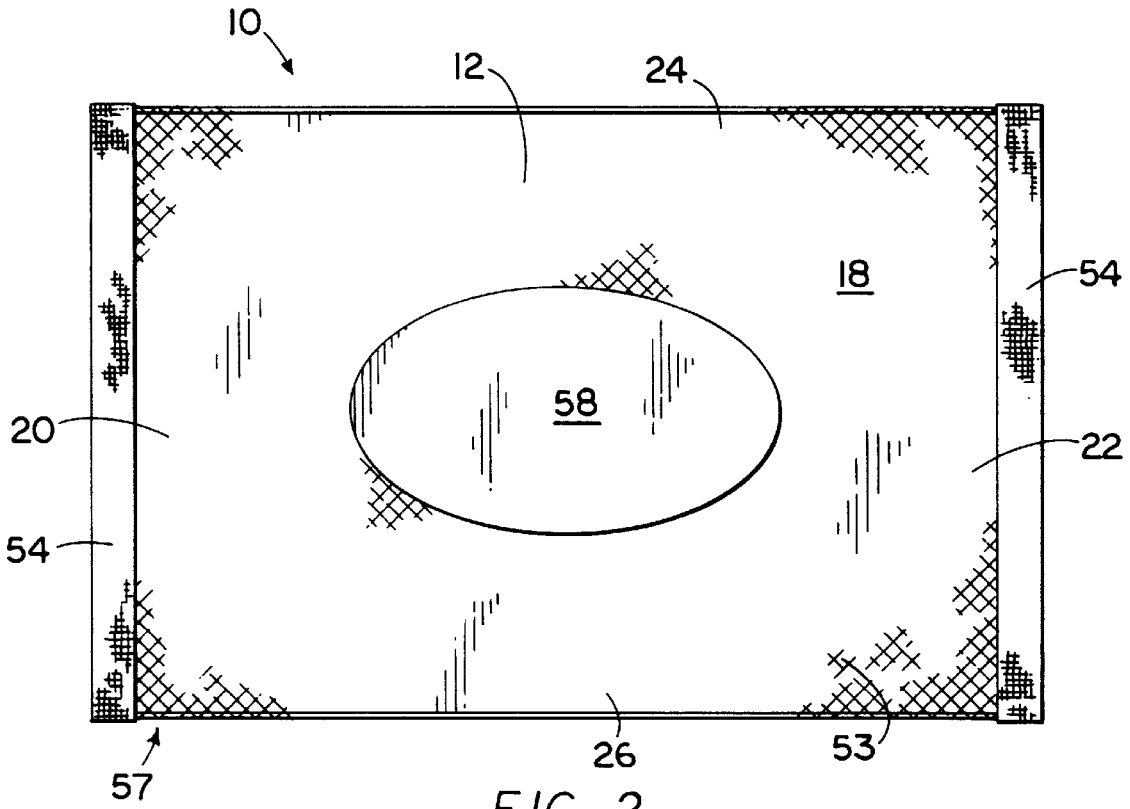
FIG. 2 is a top view of a preferred embodiment of the storage device of the present invention.
Figure 3:
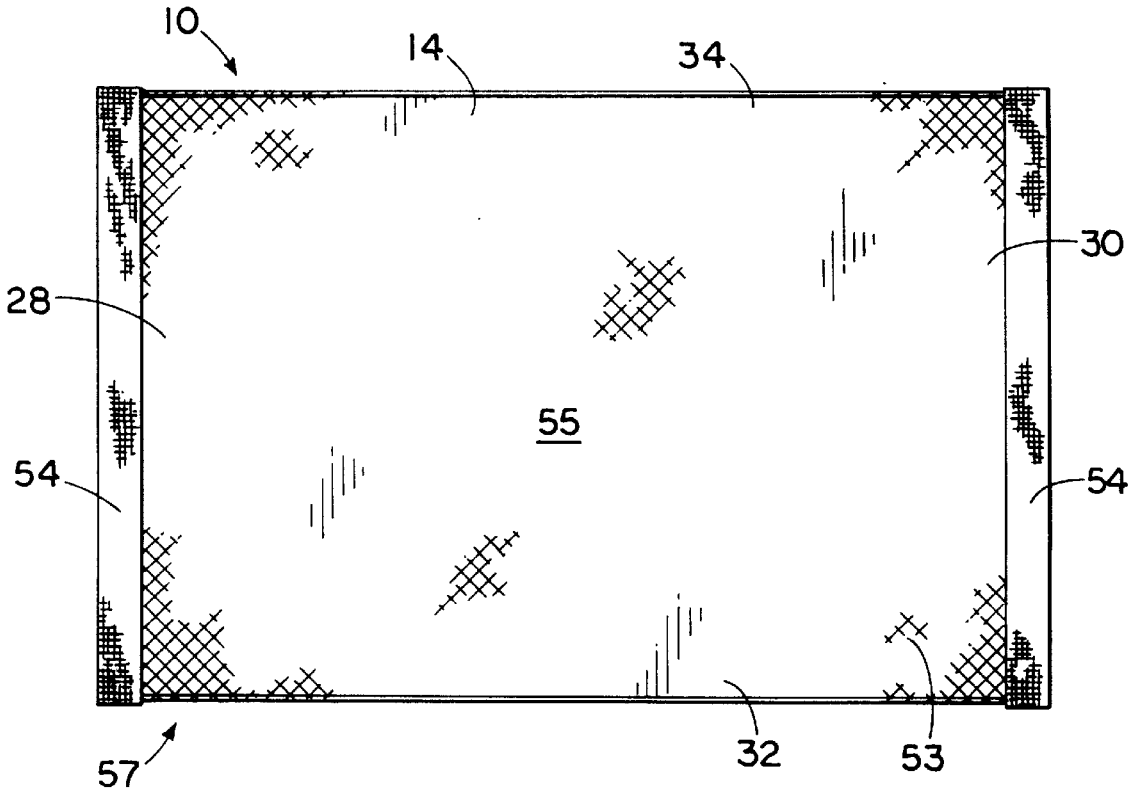
FIG. 3 is a bottom view of a preferred embodiment of the storage device of the present invention.

A storage device 10 is shown in FIGS. 1 through 8. The device comprises a top panel 12 and a bottom panel 14 which has substantially the same dimensions as the top panel, and is aligned directly beneath the top panel. The top and bottom panels are coplanar. The top panel has an inward facing surface 16, an outward facing surface 18, a front edge 20, a rear edge 22, a first side edge 24 and a second side edge 26. Likewise, the bottom panel has a front edge 28, a rear edge 30, a first side edge 32, and a second side edge 34. The top and bottom panels are joined by a first side panel 36, second side panel 38 and rear panel 40. The first side panel has a top edge 42, a front edge 43, a bottom edge 44, and a rear edge 45; the second side panel has a top edge 46, a front edge 47, a bottom edge 48, and a rear edge 49; and, the rear panel has a top edge 50 and a bottom edge 52.

When assembled, the first side panel top edge 42 is affixed to the top panel first side edge 24, and the first side panel bottom edge 44 is affixed to the bottom panel first side edge 32. Likewise, the second side panel top edge 46 is affixed to the top panel second side edge 26, and the second side panel bottom edge 48 is affixed to the bottom panel second side edge 34. The rear panel top edge 50 is affixed to the top panel rear edge 22, and the rear panel bottom edge 52 is attached to the bottom panel rear edge 30.

In a preferred embodiment, the top panel 12 and the bottom panel 14 are formed from a substantially rigid sheet material, such as cardboard, plastic, nylon, PVC, sheet metal or wood. The first side panel 36, the second side panel 38, and the rear panel 40 are formed from a breathable flexible material such as fabric or netting.

In a preferred embodiment, the first side panel top edge 42 overlaps the top panel first side edge 24 and is secured in place with an adhesive. Similarly, the first side panel bottom edge 44 overlaps the bottom panel first side edge 32 and is secured in place with an adhesive. The second side panel 38 and the rear panel 40 are affixed in a similar fashion to the top panel 12 and the bottom panel 14.

In a most preferred embodiment, the first side panel 36 and the second side panel 38 are formed from a continuous sheet of flexible material 53, which is adhered to the outward facing surface 18 of the top panel. It then extends over the top panel first edge 24 to form first side panel 36. The continuous sheet of flexible material then extends around bottom panel first edge 32 and is adhered to the outward facing surface 55 of the bottom panel 14. It then extends over the bottom panel second edge 34 to form second side panel 38. The continuous sheet of flexible material then extends around the top panel second edge 26, and is adhered to the outward facing surface of the top panel.

In use, the storage device 10 resembles a rectangular box having a front end 57 which is open. In a preferred embodiment, the front end is trimmed with a flexible binding 54 to cover rough edges and provide a finished appearance. Preferably, the top panel rear edge 22, the bottom panel rear edge 30, the first side panel rear edge 45, and the second side panel rear edge 49 are also trimmed with flexible binding.

Figure 6:
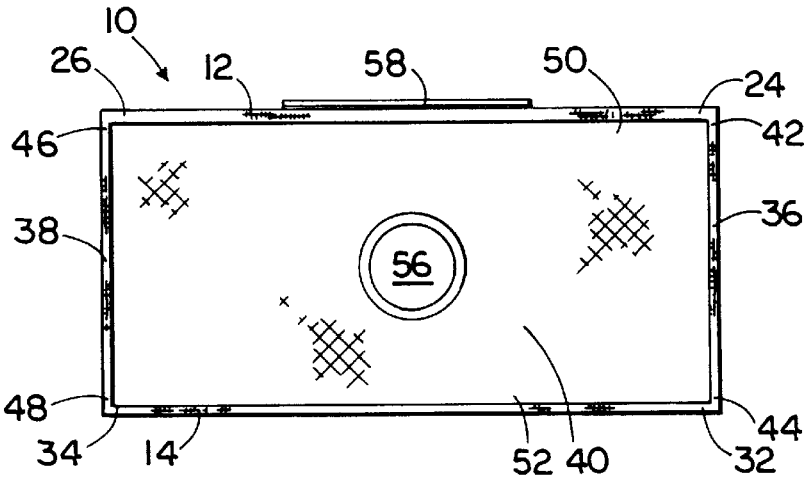
FIG. 6 is a rear view of a preferred embodiment of the storage device of the present invention.

In an alternative preferred embodiment as shown in FIG. 6, an aperture 56 is provided in the rear panel 40 of the storage device 10 to accommodate the passage of power cords and the like (not shown).

Figure 7:
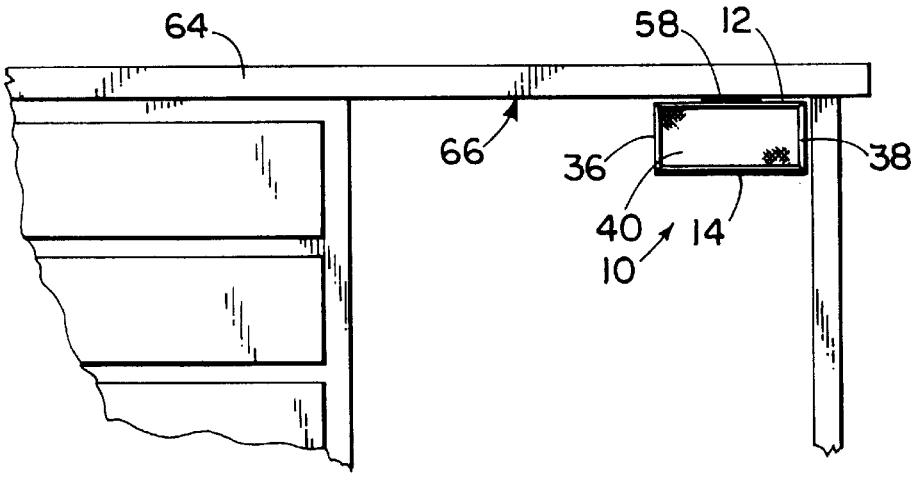
FIG. 7 is a front view of a preferred embodiment of the storage device of the present invention.

The storage device 10 is attachable to a horizontal surface, as shown in FIG. 7., so that the bottom panel 14 is suspended below the top panel 12. The top panel is removably attachable to a horizontal surface using a fastener. In a preferred embodiment, the fastener is a hook and loop fastener 58 attached to the outward facing surface 18 of the top panel.

Figure 4:
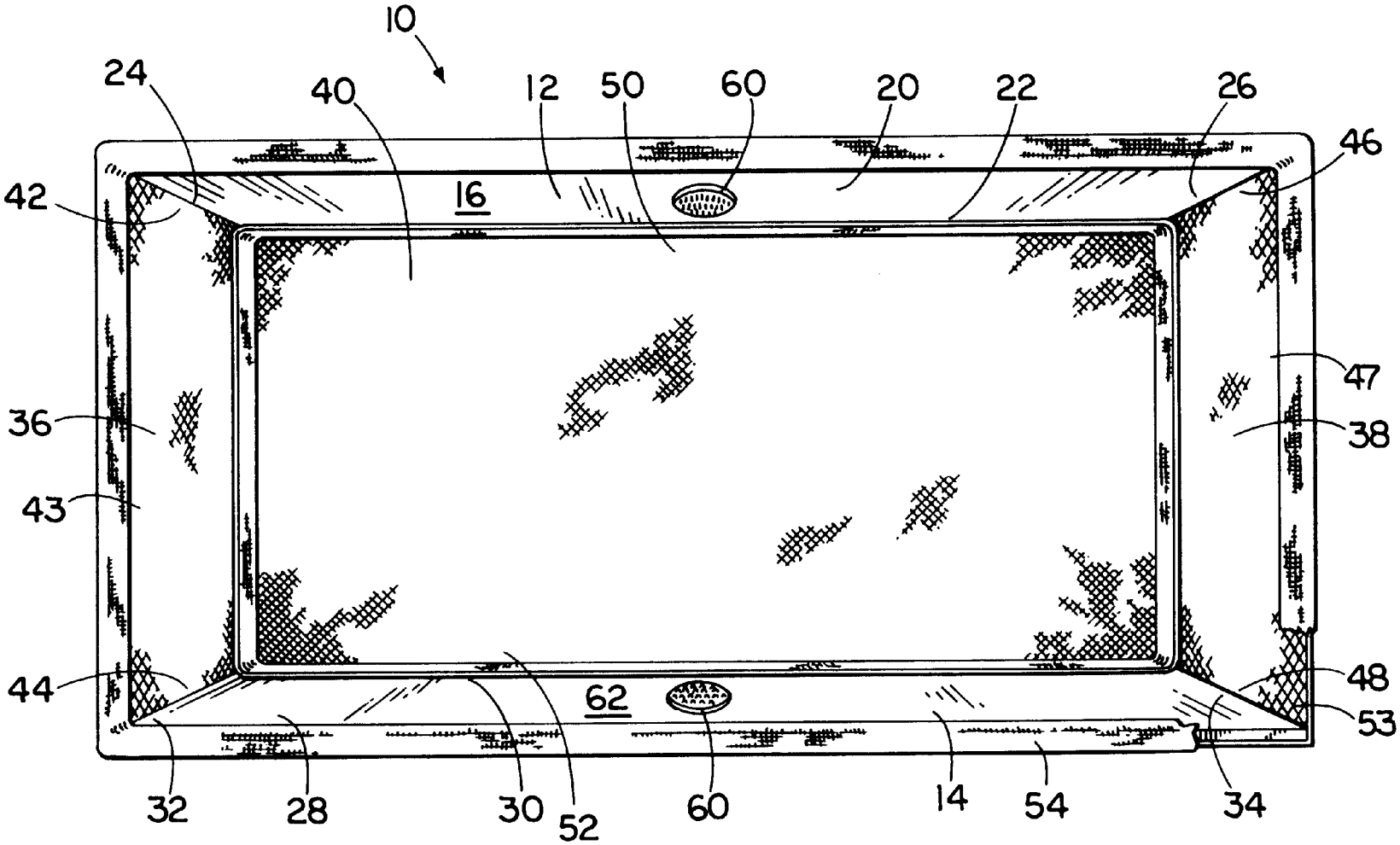
FIG. 4 is a front view of a preferred embodiment of the storage device of the present invention.
Figure 5:
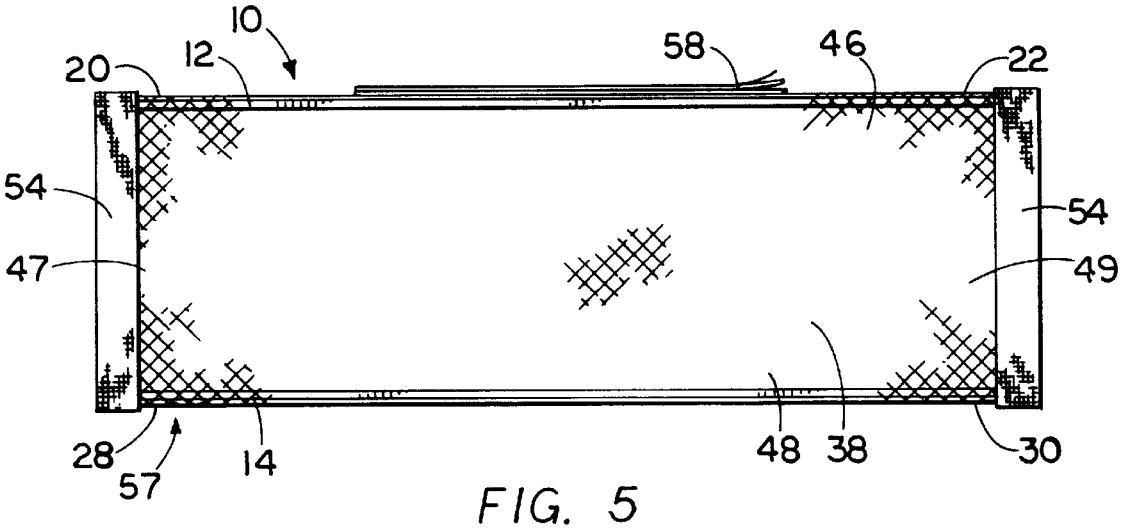
FIG. 5 is a side view of a preferred embodiment of the storage device of the present invention.
Figure 8:
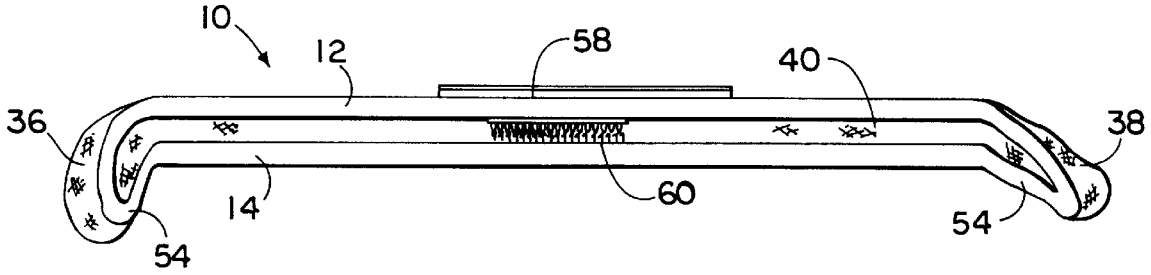
FIG. 8 is a front view of a preferred embodiment of the storage device of the present invention.

In an alternative preferred embodiment, an attachment device is provided for removably affixing the bottom panel 14 to the top panel 12 for compact storage, as shown in FIGS. 4 and 8. Hook and loop fastener 60 can serve as the attachment device, as shown in FIG. 4. Other attachment devices such as magnets (not shown) are also contemplated. The attachment device is attached to the inward facing surface 16 of the top panel and the inward facing surface 62 of the bottom panel.

In use, the storage device 10 is mounted to a horizontal surface, such as a desk 64, using the fastener provided. The top panel 12 is flush with the underside 66 of the desk, and the bottom panel 14 is suspended below the top panel, supported by the first side panel 36, the second side panel 38 and the rear panel 40. An object is then inserted in the opening between the top and bottom panels. When the storage device is in use in this manner, it is relatively inconspicuous, and does not take up floor or work area.

When the storage device 10 is empty, the bottom panel 14 may be raised up to meet the top panel 12, and held in place by engaging the fastener 60, as shown in FIG. 8. In this collapsed configuration, the storage device is compact and inconspicuous.

The storage device 10 can be removed from its mounting on a desk 64 or other surface, and stored or transported. In its collapsed form it takes up very little space.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. A storage device having:

a top panel, a bottom panel, a first side panel, a second side panel, a rear panel, and a means for attaching the storage device to a substantially horizontal surface;

the top panel and bottom panel being formed of a substantially rigid material;

the first and second side panels and the rear panel being formed of a flexible material;

the top panel having a first side edge, a second side edge, a rear edge, a front edge, an outward facing surface and an inward facing surface;

the bottom panel having a first side edge, a second side edge, a rear edge, a front edge, an outward facing surface and an inward facing surface;

the first side panel having a top edge and a bottom edge;

the second side panel having a top edge and a bottom edge;

the rear panel having a top edge and a bottom edge;

the top edge of the first side panel being affixed to the first side edge of the top panel, the bottom edge of the first side panel being affixed to the first side edge of the bottom panel, the top edge of the second side panel being affixed to the second side edge of the top panel, the bottom edge of the second side panel being affixed to the second side edge of the bottom panel, the top edge of the rear panel being affixed to the rear edge of the top panel, and the bottom edge of the rear panel being affixed to the rear edge of the bottom panel;

the means for attaching the storage device being affixed to the outward facing surface of the top panel; and a means for attaching the inward facing surface of the bottom panel to the inward facing surface of the top panel.

2. The storage device of claim 1, wherein the means for attaching the storage device to a surface comprises a hook and loop fastener.

3. The storage device of claim 1, wherein the flexible material is fabric.

4. The storage device of claim 1, wherein the substantially rigid material is selected from the group consisting of cardboard, plastic, nylon, PVC, sheet metal and wood.

5. The storage device of claim 1, wherein the means for attaching the inward facing surface of the bottom panel to the inward facing surface of the top panel comprises a hook and loop fastener.

6. The storage device of claim 1, wherein the means for attaching the inward facing surface of the bottom panel to the inward facing surface of the top panel comprises a pair of magnets.

7. A storage device having:

a top panel, a bottom panel, a first side panel, a second side panel, a rear panel, and a fastener, the top panel and bottom panel being formed of a substantially rigid material;

the first and second side panels and the rear panel being formed of a flexible material;

the top panel having a first side edge, a second side edge, a rear edge, a front edge, an outward facing surface and an inward facing surface;

the bottom panel having a first side edge, a second side edge, a rear edge, a front edge, an outward facing surface and an inward facing surface;

the first side panel having a top edge and a bottom edge;

the second side panel having a top edge and a bottom edge;

the rear panel having a top edge and a bottom edge;

the top edge of the first side panel being affixed to the first side edge of the top panel, the bottom edge of the first side panel being affixed to the first side edge of the bottom panel, the top edge of the second side panel being affixed to the second side edge of the top panel, the bottom edge of the second side panel being affixed to the second side edge of the bottom panel, the top edge of the rear panel being affixed to the rear edge of the top panel, and the bottom edge of the rear panel being affixed to the rear edge of the bottom panel;

the fastener being affixed to the outward facing surface of the top panel; and an attachment device on the inward facing surface of the top panel which can attach to the inward facing surface of the bottom panel.

8. The storage device of claim 7, wherein the fastener is a hook and loop fastener.

9. The storage device of claim 7 wherein the flexible material is fabric.

10. The storage device of claim 7 wherein the substantially rigid material is selected from the group consisting of cardboard, plastic, nylon, PVC, sheet metal and wood.

11. The storage device of claim 7, wherein the attachment device is a hook and loop fastener.

12. The storage device of claim 7, wherein the attachment device is a pair of magnets.

* * * * *